United States Patent [19]

Yoshioka

[11] 4,216,758

[45] Aug. 12, 1980

[54] AUTOMOBILE FUEL INTAKE SYSTEM

[75] Inventor: Sadashichi Yoshioka, Aki, Japan

[73] Assignee: Toyo Kogyo Co., Ltd., Hiroshima, Japan

[21] Appl. No.: 22,365

[22] Filed: Mar. 20, 1979

[30] Foreign Application Priority Data

Mar. 22, 1978 [JP] Japan ..... 53-36447[U]

[51] Int. Cl.[2] ..... F02D 17/00

[52] U.S. Cl. ..... 123/198 F; 261/23 A

[58] Field of Search ..... 123/198 F, 97 B, DIG. 7; 261/23 A

[56] References Cited

U.S. PATENT DOCUMENTS

| | | | |
|---|---|---|---|
| 2,114,655 | 4/1938 | Leibing | 123/198 F |
| 3,578,116 | 5/1971 | Nakajima | 123/97 B |
| 4,019,479 | 4/1977 | Garabedian | 261/23 A |
| 4,070,994 | 1/1978 | Garabedian | 123/198 F |
| 4,073,278 | 2/1978 | Glenn | 123/198 F |
| 4,075,837 | 2/1978 | Hanaoka | 123/198 F |
| 4,076,003 | 2/1978 | Garabedian | 261/23 A |
| 4,080,948 | 3/1978 | Dolza, Sr. | 123/198 F |
| 4,106,471 | 8/1978 | Nakajima | 123/198 F |
| 4,130,102 | 12/1978 | Churchill | 261/23 A |

*Primary Examiner*—Ira S. Lazarus

*Attorney, Agent, or Firm*—Wenderoth, Lind & Ponack

[57] ABSTRACT

A fuel intake system for a multi-cylinder internal combustion engine includes at least two intake passages leading to respective engine cylinders, and a shutter valve positioned within one of the intake passages for, when closed, allowing the entire amount of a combustible air-fuel mixture to be introduced into one of the engine cylinders communicated with the other of the intake passages. For operating the shutter valve, a composite negative pressure which is made up of a negative pressure, developed within the one of the intake passages at a position downstream of the shutter valve with respect to the direction of flow of the combustible air-fuel mixture towards the engine cylinders, and that developed within the other of the intake passages at a position downstream of a throttle valve, is utilized.

6 Claims, 3 Drawing Figures

AUTOMOBILE FUEL INTAKE SYSTEM

BACKGROUND OF THE INVENTION

The present invention generally relates to an automobile fuel intake system and, more particularly, to a fuel intake system for a multi-cylinder internal combustion engine for closing one of at least two passages leading to respective engine cylinders during a particular operating condition of the engine to allow the whole amount of air-fuel mixture to be introduced into the corresponding engine cylinder through the other of the passages, thereby to improve the efficiency of combustion occurring in such corresponding engine cylinder and to minimize the amount of noxious unburned components of the exhaust gases to be emitted to the atmosphere.

U.S. Pat. No. 2,114,655, patented on Apr. 19, 1938, discloses an automobile fuel intake system comprising a carburetor for combining fuel with air to form a combustible mixture to be supplied into a plurality of engine cylinders and including a throttle valve for controlling the rate of delivery of the combustible air-fuel mixture to the engine cylinders, an intake manifold having a common inlet, communicated to the carburetor, and branch passages equal in number to and communicated respectively to the engine cylinders, and shutter valves each in the form of a butterfly valve operatively positioned within certain of the branch passages for, during a particular operating condition of the engine, for example, during shifting, coasting, braking and like operations, closing such certain of the branch passages, the combustible air-fuel mixture being, however, introduced into all of the engine cylinders during the time that the engine is pulling a load.

A system similar to that described above is also disclosed in the U.S. Pat. No. 3,578,116, patented on May 11, 1971.

A feature of interest in terms of present invention, which is common to the both of the above mentioned U.S. patents, resides in that a negative pressure developed within the intake system at a position upstream of the shutter valves with respect to the direction of flow of the combustible air-fuel mixture towards the engine cylinders is utilized as an operating signal necessary for the shutter valves to be selectively closed and opened depending upon the engine operating condition. Specifically, the shutter valves are so associated and so arranged as to be closed and opened respectively when the negative pressure upstream of the shutter valves exceeds a predetermined value and when it falls below the predetermined value. In this arrangement, the shutter valves tend to undergo a surging motion, i.e., repeated cycles of opening and closing, in such a manner that, when the negative pressure upstream of the shutter valves exceeds the predetermined value and the shutter valves are therefore closed, the closure of the shutter valves results in reduction of the negative pressure upstream of the shutter valves to such an extent as to cause it to fall below the predetermined value, thereby opening the shutter valves, which in turn results in increase of the negative pressure upstream of the shutter valves to such an extent as to exceed the predetermined value. The surging motion tends to adversely affect the performance of the engine and, therefore, should be removed.

According to the Japanese Utility Model Publication No. 52-18342, published on Apr. 25, 1977, the invention of which has been assigned to the assignee of the present invention, there is disclosed a carburetor for combining fuel with air to provide a combustible mixture which is to be supplied into at least two engine cylinders through respective intake passages, throttle valves equal in number to the number of the intake passages and operatively positioned therein for controlling the rate of delivery of the combustible mixture to the respective engine cylinders, a connecting passage communicating between the intake passages at a position downstream of any one of the throttle valves with respect to the direction of flow of the combustible mixture towards the engine cylinders, and a shutter valve operatively positioned within one of the intake passages at a position downstream of and proximate to the connecting passage such that, when the shutter valve is held in position to close such one intake passage during a particular engine operating condition, namely, when the throttle valves are substantially closed and the engine is operated at a high speed, a portion of the combustible mixture flowing through such one intake passage can be introduced into the other of the intake passages.

In this Japanese publication, for operating the shutter valve which is normally biased by a spring element to open such one intake passage, an electromagnetic actuator is employed in combination with series-connected switches, one used to detect the position of the throttle valve and the other used to detect the speed of rotation of the engine. However, this device does not utilize a negative pressure upstream of the shutter valve for operating the latter such as employed in the earlier mentioned U.S. patents, although there is no substantial possibility of the occurrance of the surging motion of the shutter valve because of the employment of a mechanical linkage system between the shutter valve and the electromagnetic actuator.

Although the above mentioned Japanese publication describes the possible utilization of the negative pressure in combination with a diaphragm valve, instead of the electric current including the electromagnetic actuator, for operating the shutter valve, it has failed to disclose a specific fluid circuit through which the requisite negative pressure is drawn and a specific arrangement of the diaphragm valve in relation to the fluid circuit.

If one can conceive of the possibility of utilization of the negative pressure downstream of the shutter valve and merely applies it to the device of the above mentioned Japanese publication in place of the fluid circuit including the electromagnetic actuator, there would be a critical problem. In other words, although there is no problem where the negative pressure downstream of the shutter valve is utilized to close the shutter valve when it exceeds the predetermined value with the throttle valve opened, reduction of the negative pressure downstream of the shutter valve will no longer take place during the opening of the throttle valve once the shutter valve has been closed and, therefore, the once-closed shutter valve will become incapable of being opened.

SUMMARY OF THE INVENTION

Accordingly, the object of the present invention is to provide an improved fuel intake system for a multi-cylinder internal combustion engine, which is so carefully designed as to substantially eliminate the above described disadvantages and inconveniences inherent in the prior art systems of a similar kind.

Another object of the present invention is to provide an improved fuel intake system of the type referred to above wherein the negative pressure developed downstream of the shutter valve is effectively utilized to control the operation of the shutter valve even though the latter is held in position to close one of at least two intake passages wherein such shutter valve is operatively installed.

A further object of the present invention is to provide an improved fuel intake system of the type referred to above, which can readily be manufactured with a minimum number of component parts and which does not require such a complicated adjustment as would be required in the case of the employment of a complicated mechanical linkage system for enabling the shutter valve or shutter valves to be operated in response to the position of the throttle valve.

These and other objects of the present invention can be accomplished by utilizing a composite negative pressure made up of a negative pressure developed within one of at least two intake passages and downstream of the shutter valve and a negative pressure developed within the other of the intake passages. In order to operate the shutter valve, i.e., to move the shutter valve between closed and opened positions, valve means capable of being controlled by the composite negative pressure is utilized.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
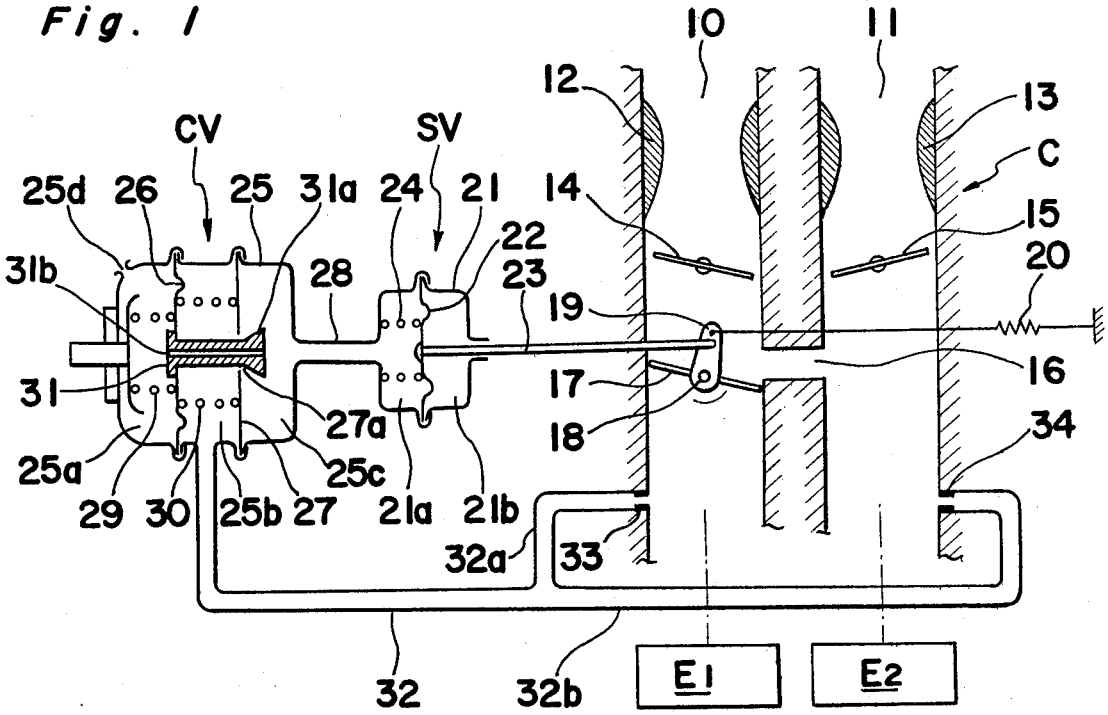
FIG. 1 is a schematic longitudinal sectional view of a fuel intake system of a multi-cylinder internal combustion engine according to one preferred embodiment of the present invention.

Before the description of the present invention proceeds, it is to be noted that like parts are designated by like reference numerals throughout the accompanying drawings. It is also to be noted that the concept of the present invention is particularly advantageously applicable to a multi-cylinder internal combustion engine having independent fuel intake passages, one for each engine cylinder or each group of some of the engine cylinders. This type of internal combustion engine is well known to those skilled in the art. In the following detailed description of the present invention, the present invention will be described as applied to an internal combustion engine having at least two engine cylinders E1 and E2 for the sake of brevity, it however being understood that the concept of the present invention can equally be applicable to an internal combustion engine having three or more engine cylinders.

Referring now to FIG. 1, there are shown the engine cylinders E1 and E2 fluid-connected to a carburetor C of any known construction. So far as illustrated, the carburetor C has first and second spaced intake ducts 10 and 11, communicated respectively to the engine cylinders E1 and E2 through independent connecting ducts (not shown), and includes first and second venturis 12 and 13 and first and second throttle valves 14 and 15 positioned respectively in first and second intake ducts 10 and 11 in a manner well known to those skilled in the art. The first and second intake ducts 10 and 11 are communicated to each other by means of a connecting passage 16 defined in a partition wall separating the intake ducts 10 and 11 from each other in the carburetor C.

A shutter valve 17 in the form of a butterfly valve is operatively positioned within one of the first and second intake ducts, for example, in the first intake duct 10 as shown, and is positioned downstream of the corresponding throttle valve 14 and also downstream of and proximate to one of the opposed openings of the connecting passage 16, which opens into the intake duct 10, with respect to the direction of flow of a combustible air-fuel mixture formed in the carburetor C in a manner known to those skilled in the art and flowing towards the corresponding engine cylinder E1 through the intake duct 10. This shutter valve 17 is rigidly mounted on a shaft 18 for rotation together therewith, shaft 18 having one end rotatably supported by a portion of a wall defining the intake duct 10 and the other end rotatably extending through the opposite portion of the same wall defining the intake duct 10 and terminating outside the carburetor C. Rigidly mounted on the free end of the shaft 18 and positioned externally of the carburetor C is a connecting arm 19 which is in turn coupled to a source of drive necessary to rotate the shutter valve 17 between closed and opened positions as will be described later in detail.

This shutter valve 17 serves to allow the combustible air-fuel mixture flowing through the intake duct 10 to be introduced into the intake duct 11 through the connecting passage 16 when valve 17 is held in the closed position as shown, the combustible air-fuel mixture so introduced into the intake duct 11 being admixed with a similar combustible air-fuel mixture flowing through the intake duct 11 prior to the introduction thereof into the corresponding engine cylinder E2. The connecting passage 16 must have an effective cross sectional surface area sufficiently large to enable the introduction of the combustible air-fuel mixture from the first intake duct 10 into the second intake duct 11 during the closure of the shutter valve, thereby to improve the efficiency of combustion which subsequently occurs in the engine cylinder E2 and, on the other hand, sufficiently small as to avoid any possible interference in pressure between the first and second intake ducts 10 and 11 throughout all of the engine operating conditions. To satisfy this requirement, the effective cross sectional surface area of the connecting passage 16 should be so selected that the ratio A2/A1 of the effective cross sectional surface area A2 of the connecting passage 16 relative to the effective cross sectional surface area A1 of any one of the first and second intake ducts 10 and 11 is not more than 1/6.

For providing the drive necessary to rotate the shutter valve 17 between the closed and opened positions, particularly for rotating the shutter valve 18 from the opened position towards the closed position against a return spring 20, which is used to bias the shutter valve 17 towards the opened position, when a composite negative pressure made up of the negative pressures respectively developed in the first and second intake ducts 10 and 11 in a manner as will be described later exceeds a predetermined value, a servo diaphragm valve assembly generally identified by SV is employed. This servo diaphragm valve assembly SV may be of any known construction and, so far as illustrated, comprises a valve casing 21, the sealed interior of which is divided into first and second working chambers 21*a* and 21*b* by a diaphragm member 22. The diaphragm member 22 is in turn coupled to the connecting arm 19 through any suitable linkage system, for example, a transmission rod 23 having one end pivotally connected to the connecting arm 19 and the other end loosely extending through the second working chamber 21*b* and rigidly connected to the diaphragm member 22. The diaphragm member 22 is displaceable between first and second positions and is normally biased to the first position by a biasing spring 24 housed within the first working chamber 21*a*, the second working chamber 21*b* being communicated to the atmosphere.

The operation of the servo diaphragm valve assembly SV is controlled by a control valve assembly generally shown by CV of a construction which will now be described.

The control valve assembly CV comprises a valve casing 25, the interior of which is divided into first, second and third chambers 25*a*, 25*b* and 25*c*, first chamber 25*a* being defined by the valve casing 25 and a diaphragm member 26 and communicated to the atmosphere through a vent hole 25*d*; second chamber 25*b* being defined by the valve casing 25 at a position between the diaphragm member 26 and a partition wall 27; and third chamber 25*c* being defined by the valve casing 25 and the partition wall 27 and communicated to the first working chamber 21*a* of the servo diaphragm valve assembly SV through a connecting duct 28. The first chamber 25*a* has a balancing spring 29 positioned between the casing 25 and the diaphragm member 26, while the second chamber 25*b* has a biasing spring 30 positioned between the diaphragm member 26 and the partition wall 27 and biasing the diaphragm member 26 towards a closed position, diaphragm member 26 being however shown in FIG. 1 as held in an opened position against the biasing spring 30 for a reason which will be described later.

The control valve assembly CV further comprises a sleeve member 31 having one end rigidly connected to the diaphragm member 26 and the other end outwardly enlarged at 31*a*, the outwardly enlarged portion 31*a* of the sleeve member 31 being axially movably extending through an opening 27*a* in the partition wall 27 and terminating within the third chamber 25*c*. It is to be noted that the opening 27*a* in the partition wall 27 is normally closed by the outwardly enlarged portion 31*a* of the sleeve member 31 by the action of the biasing spring 30 urging the diaphragm member 26 to the closed position when and so long as no composite negative pressure is introduced into the second chamber 25*b* in a manner as will be described later. Consequently, it will readily be understood that, when and so long as the opening 27*a* in the partition wall 27 is closed in the manner described above, all of the first working chamber 21*a* of the servo diaphragm valve assembly SV, the connecting duct 28 and the third chamber 25*c* of the control valve assembly CV appear to be hermetically sealed. However, the sleeve member 31 communicates the first working chamber 21*a* of the servo diaphragm valve assembly SV to the atmosphere through the hollow 31*b* in the sleeve member 31 and by way of the vent hole 25*d* via the first chamber 25*a* and, therefore, it is clear that the shutter valve 17 is biased to the opened position by the action of the return spring 20 when and so long as no composite negative pressure is introduced into the second chamber 25*b* of the control valve assembly CV.

In the construction so far described, when the composite negative pressure introduced into the second chamber 25*b* exceeds a predetermined value, the diaphragm member 26 is drawn towards the opened position against the biasing spring 30, accompanied by an axial movement of the sleeve member 31 in a direction towards the right as viewed in FIG. 1. Upon movement of the sleeve member 31 to the right, the outwardly enlarged portion 31*a* of the sleeve member 31 opens the opening 27*a* in the partition wall 27, thereby allowing the composite negative pressure to be introduced into the first working chamber 21*a* of the servo diaphragm valve assembly SV through the connecting duct 28. With the composite negative pressure so introduced into the first working chamber 21*a*, the diaphragm member 22 of the servo diaphragm valve assembly SV is displaced towards the second position against the biasing spring 24 and, consequently, the shutter valve 17 is rotated from the opened position towards the closed position against the return spring 20. However, when the composite negative pressure introduced into the second chamber 25*b* of the control valve assembly CV subsequently falls below the predetermined value, the shutter valve 17 which has been held in the closed position as shown can return to the opened position as pulled by the return spring 20.

For introducing the composite negative pressure into the second chamber 25*b* of the control valve assembly CV, the second chamber 25*b* is connected to both of the first and second intake ducts 10 and 11 by means of a passage 32 having one end communicated to the second chamber 25*b* and the other end communicated to the first and second intake ducts 10 and 11 through respective branch passages 32*a* and 32*b*. A free open end of the branch passage 32*a* remote from the passage 32 has an orifice 33 and opens towards the first intake duct 10 at a position downstream of the shutter valve 17 with respect to the direction of flow of the combustible mixture towards the engine cylinder E1. Similarly, a free end of the branch passage 32*b* remote from the passage 32 has an orifice 34 and opens towards the second intake duct 11 at a position downstream of the throttle valve 15 in the second intake duct 11.

From the foregoing, it will readily be seen that the composite negative pressure utilizable to control the shutter valve 17 is made up of the negative pressure developed in the first intake duct 10 at a position downstream of the shutter valve 17, and the negative pressure developed in the second intake duct 11 at a position downstream of the throttle valve 15 in the second intake duct 11. The magnitude of this composite negative pressure can be determined by suitably selecting the sizes, particularly the effective cross sections, of the respective orifices 33 and 34, but may vary depending upon characteristics of the internal combustion engine and/or the engine operating condition during which the shutter valve 17 is desired to be operated.

However, in order to effectively avoid the possible occurrence of a surging motion of the shutter valve 17, the orifices 33 and 34 should be so selected that, when the composite negative pressure is likely to attain the predetermined value at which the shutter valve 17 is closed, the composite negative pressure developed immediately after the closure of the shutter valve 17 can, without fault, become equal to or higher than the composite negative pressure developed shortly before the closure of the shutter valve 17. In addition, in order to enable the shutter valve 17 to be opened during a particular engine operating condition, care must be taken that the composite negative pressure developed during such particular engine operating condition should be of a value lower than the predetermined composite negative pressure. In particular, the closure of the shutter valve 17 according to the present invention occurs during deceleration or idling of the internal combustion engine to which the present invention is applied.

Figure 2:
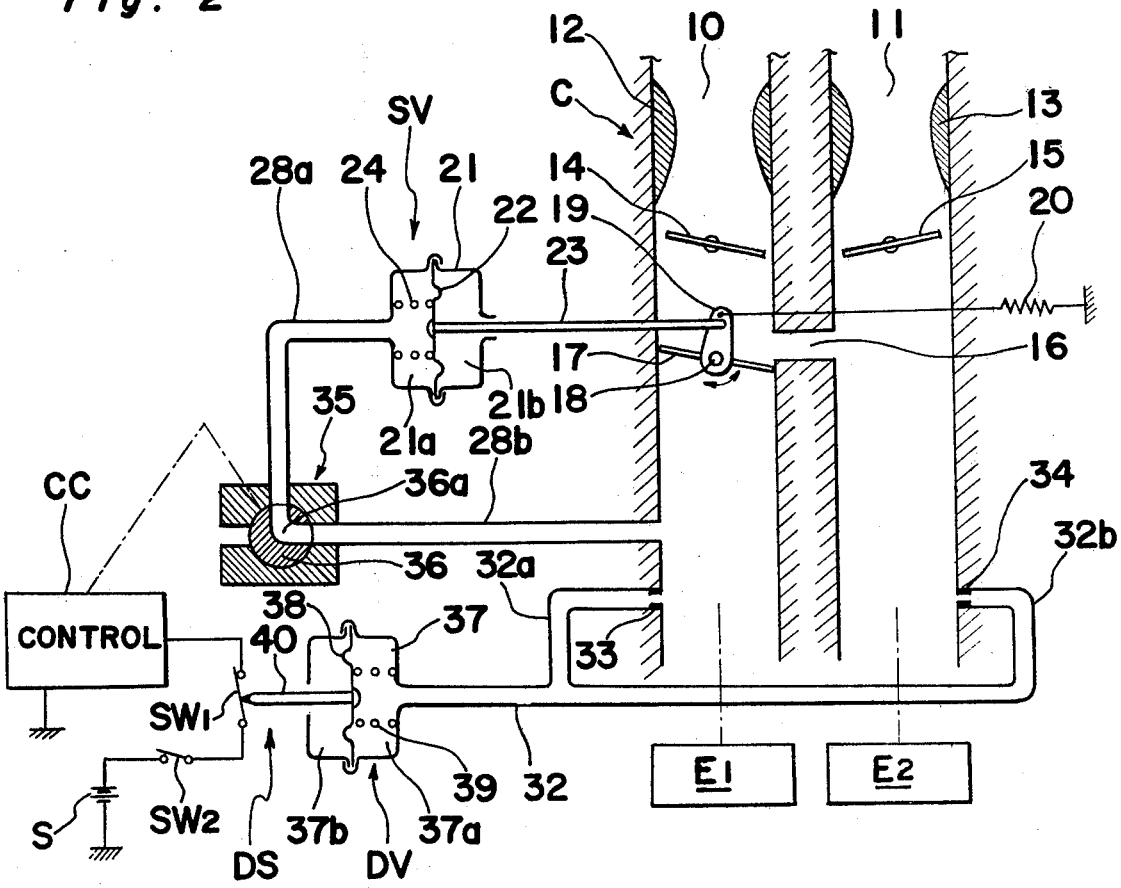
FIGS. 2 and 3 are views similar to FIG. 1, showing other preferred embodiments of the present invention, respectively.

In another embodiment of the present invention as shown in FIG. 2, instead of the control valve assembly CV which has been described as employed in the embodiment of the present invention shown in FIG. 1, an electromechanical control device is utilized.

Referring now to FIG. 2, the first working chamber 21*a* of the servo diaphragm valve assembly SV is communicated to a connecting duct 28*a* which is in turn connected to a connecting duct 28*b* through an electromagnetically operated three-way switching valve 35 forming a part of the electromechanical control device. One end of the connecting duct 28*b* remote from the switching valve 35 opens into the first intake duct 10 at a position downstream of the shutter valve 17. The switching valve 35 includes a rotor 36 having a substantially L-shaped passage 36*a* defined therein, rotor 36 being motor-driven between first and second positions when an electric signal is applied thereto from a control circuit CC as will be described later. It is to be noted that, when the rotor 36 of the switching valve 35 is held in the first position, the L-shaped passage 36*a* in the rotor 36 communicates the connecting duct 28*a* to the atmosphere while, when the rotor 36 is held in the second position as shown, the L-shaped passage 36*a* communicates the connecting duct 28*a* to the connecting duct 28*b*. Accordingly, it is clear that, when and so long as the rotor 36 is held in the second position, the negative pressure developed within the first intake duct 10 downstream of the shutter valve 17 can be introduced into the first working chamber 21*a* of the servo diaphragm valve assembly SV to displace the diaphragm member 22 towards the second position against the biasing spring 24, thereby closing the shutter valve 17. So far as the embodiment shown in FIG. 2 is involved, the negative pressure within the first intake duct 10 downstream of the shutter valve 17, not the composite negative pressure as is the case in the foregoing embodiment of FIG. 1, provides a drive necessary to close the shutter valve 17 against the return spring 20, but the operation of the servo diaphragm valve assembly SV is controlled by the composite negative pressure as can readily understood from the subsequent description.

The electromechanical control device includes a diaphragm switch assembly generally identified by DS. This diaphragm switch assembly comprises a diaphragm valve DV constituted by a valve casing 37, the interior of which is divided into first and second chambers 37*a* and 37*b* by a diaphragm member 38, first and second chambers 37*a* and 37*b* being respectively communicated to the passage 32 and to the atmosphere. The diaphragm valve DV further includes a biasing spring 39 for biasing the diaphragm member 38 to an opened position and an actuating rod 40 having one end rigidly connected to the diaphragm member 38, diaphragm member 38 being displaceable towards a closed position against the biasing spring 39 when the composite negative pressure introduced into the first chamber 37*a* exceeds a predetermined value. The diaphragm switch assembly DS further comprises a switch SW1 operatively associated with the actuating rod 40 in such a manner that, when the diaphragm member 38 is held in the opened position as biased by the biasing spring 39, the switch SW1 is opened and, when the diaphragm member 38 is displaced to the closed position against the biasing spring 39 by the action of the composite negative pressure introduced into the first working chamber 37*a*, the switch SW1 is closed.

The switch SW1 is inserted between control circuit CC and a key switch SW2 which is electrically connected to a source of electric power S. The control circuit CC is so operatively associated with the electromagnetically operated three-way switching valve assembly 35 that, when and so long as both of the switches SW1 and SW2 are closed, the control circuit CC generates a control signal necessary to rotate the rotor 36 from the first position, in which the connecting duct 28*a* is communicated to the atmosphere through the L-shaped passage 36*a*, towards the second position to communicate the connecting duct 28*a* to the connecting duct 28*b* through the L-shaped passage 36*a*, the rotor 36 being, however, returned to the first position during the absence of the control signal, that is, during the opening of the switch SW1 while the switch SW2 is closed. Alternately, the control circuit CC may be of a type capable of generating two types of different signals, one being used to rotate the rotor 36 from the first position to the second position during the closure of the switch SW1 and the other being used to rotate the rotor 36 from the second position back to the first position during the opening of the switch SW1.

From the foregoing, it will readily be seen that even the system of the construction shown in FIG. 2 functions in a substantially similar manner as described in connection with the system of the construction shown in FIG. 1.

In the foregoing description of any one of the preferred embodiments of the present invention shown in FIGS. 1 and 2, respectively, the fuel intake system has been described as having two fuel intake passages, one for each of engine cylinders E1 or E2 which are independent from each other and, therefore, utilizing carburetor C of a type having independent intake ducts 10 and 11 with respective throttle valves therein. In this case, the connecting passage 16 is essential. However, the concept of the present invention can equally be applicable to a multi-cylinder internal combustion engine utilizing a carburetor of a type having a single intake duct which is communicated to a plurality of, for example, at least two, engine cylinders through an intake manifold of a construction having one inlet communicated to the intake duct in the carburetor and two outlets respectively communicated to the engine cylinders. An example of this arrangement is shown in FIG. 3, reference to which will now be made.

Figure 3:
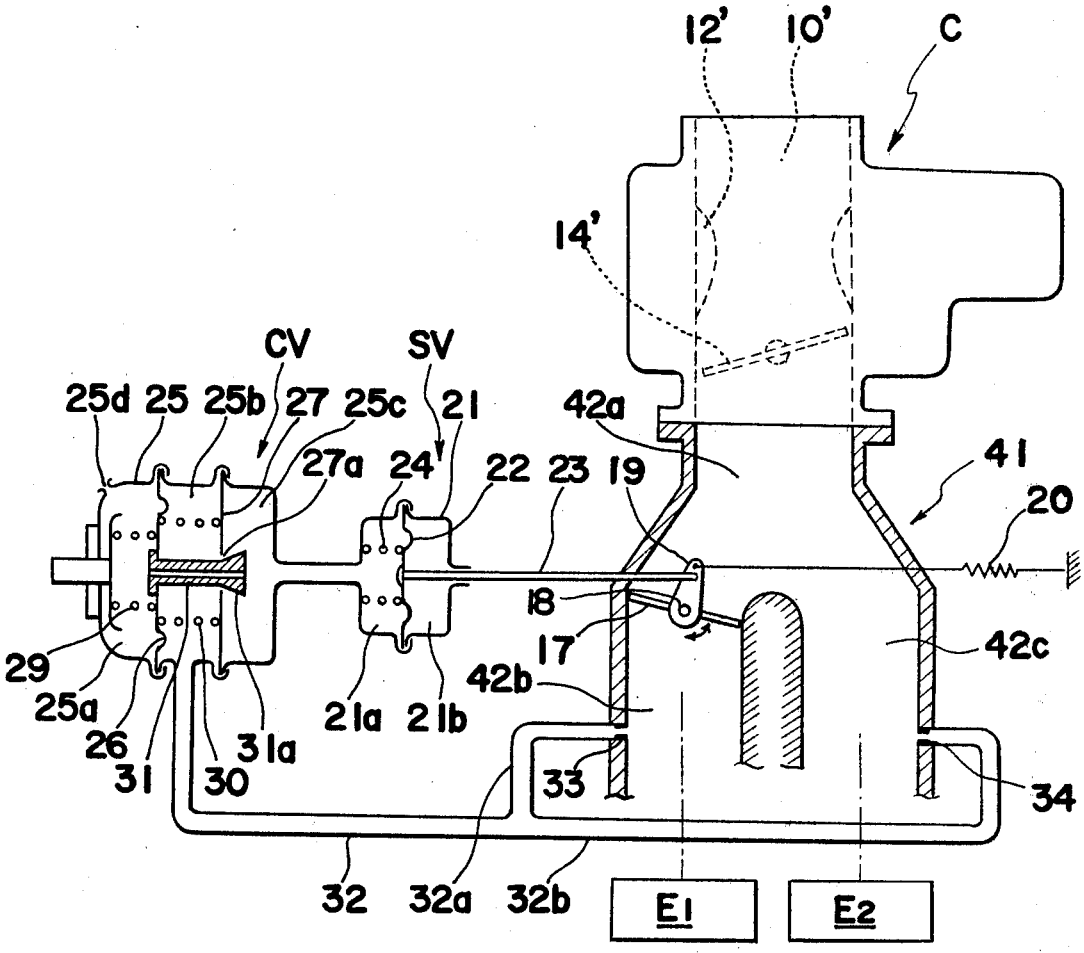

Referring to FIG. 3, the carburetor C is shown as having a single intake duct 10' having a venturi 12' and a throttle valve 14' incorporated therein. This intake duct 10' is fluid-connected to the engine cylinders E1 and E2 by means of an intake manifold 41 comprised of an upstream passage 42*a* having one end communicated to the intake duct 10' and the other end communicated to the engine cylinders E1 and E2 through respective branch passages 42*b* and 42*c*.

The shutter valve 17 is shown as operatively positioned in the branch passage 42*b* at a location preferably proximate to the junction of the passages 42a, 42b and 42c so that, when the shutter valve 17 is closed, the entire amount of the combustible air-fuel mixture flowing through the upstream passage 42a can flow into the branch passage 42c. The arrangement so far described is substantially disclosed in the earlier mentioned U.S. Pat. No. 3,578,116 and, therefore, reference may be had thereto.

From the foregoing description of the present invention, it is clear that the shutter valve 17 can be closed when the composite negative pressure exceeds the predetermined value, for example, during deceleration or idling of the engine, thereby enabling the combustion of the combustible air-fuel mixture, introduced into some of the engine cylinders, i.e., the engine cylinder E2, to be effected efficiently. The consequence is that the possible emission of noxious unburned components of the exhaust gases produced subsequent to the combustion can advantageously be minimized. In addition, in view of the utilization of the composite negative pressure made up of the negative pressures respectively developed within the intake ducts 10 and 11 at respective positions downstream of the shutter valve 17 and downstream of the throttle valve 15, the possibility of the shutter valve undergoing a surging motion can advantageously be eliminated.

Although the present invention has been fully described in connection with the preferred embodiments thereof, it should be noted that various changes and modifications will be apparent to those skilled in the art. By way of example, in any one of the embodiments shown respectively in FIGS. 1 and 2, the connecting passage 16 which has been described as defined in the partition wall separating the intake ducts 10 and 11 from each other in the carburetor C may be defined at a junction between the carburetor and the intake manifold and, in this case, the shutter valve 17 is to be installed in one of the independent passages in the intake manifold. Alternatively, both the connecting passage 16 and the shutter valve 17 may be installed in the intake manifold.

Accordingly, such changes and modifications are to be understood as included within the true scope of the present invention unless they depart therefrom.

I claim:

1. A fuel intake system for a multi-cylinder internal combustion engine having at least first and second engine cylinders, which comprises, in combination:

an intake passage means having inlet means communicated to a source of combustible air-fuel mixture and at least first and second outlet conduits communicated respectively to the first and second engine cylinders;

throttle valve means adjustably positioned in said inlet means for controlling the rate of delivery of the combustible air-fuel mixture to the engine cylinders;

at least one shutter valve operatively positioned in said first outlet conduit for pivotal movement between opened and closed positions at a position downstream of the throttle valve means with respect to the direction of flow of the combustible air-fuel mixture towards the engine cylinders;

biasing means for urging said shutter valve to the opened position; and means operable in response to a composite negative pressure, made up of a negative pressure developed in the first outlet conduit downstream of the shutter valve and a negative pressure in the second outlet conduit, for bringing the shutter valve to the closed position against the biasing means, when said composite negative pressure exceeds a predetermined value, thereby communicating the second engine cylinder to the source of the combustible air-fuel mixture.

2. A system as claimed in claim 1, wherein said inlet means is comprised of first and second inlet ducts and said throttle valve means is installed in each of said first and second inlet ducts, said first and second inlet ducts being respectively communicated to the first and second outlet conduits, and further comprising a connecting passage communicating between a first fluid circuit of the first inlet duct and first outlet conduit and a second fluid circuit of the second inlet duct and second outlet conduit, said connecting passage being defined at a position upstream of and proximate to the shutter valve.

3. A system as claimed in claim 2, wherein said connecting passage has an effective cross section not larger than one sixth of that of any one of the first and second fluid circuits.

4. A system as claimed in claim 1, wherein said means operable in response to the composite negative pressure comprises;

a first diaphragm valve assembly comprising a first valve casing including a first diaphragm member defining first and second working chambers one on each side of the first diaphragm member within said casing, said first diaphragm member being displaceable between first and second positions and normally biased to the first position, said second working chamber being communicated to the atmosphere, a linkage means for transmitting the diaplacement of the first diaphragm member to the shutter valve, said shutter valve being brought to the closed position against the biasing means when the first diaphragm member is displaced from the first position to the second position, a fluid suction passage means having one end communicated to the first working chamber of the first diaphragm valve assembly and the other end constituted by first and second branch passages opening respectively into the first and second outlet conduits at positions downstream of the shutter valve and the throttle valve means, and a second diaphragm valve assembly positioned on the fluid suction passage between the first diaphragm valve assembly and the junction of the fluid suction passage and the branch passages for introducing the composite negative pressure into the first working chamber of the first diaphragm valve assembly only when the composite negative pressure exceeds the predetermined value, thereby displacing the first diaphragm member to the second position.

5. A system as claimed in claim 4, wherein said second diaphragm valve assembly comprises a second valve casing having third, fourth and fifth working chambers defined within said second valve casing, said third and fifth working chambers being respectively communicated to the atmosphere and the first working chamber of the first diaphragm valve assembly while said fourth working chamber is communicated to both of the branch passages, a second diaphragm member positioned intermediately between the third and fourth working chambers, a perforated partition wall positioned intermediately between the fourth and fifth working chambers, and a sleeve member having one end rigidly connected to the second diaphragm member and the other end adapted to selectively close and open the perforation in the partition wall, said sleeve member having an axial hole communicating the fifth working chamber to the atmosphere by way of the third working chamber, said second diaphragm member being displaced in one direction, when the composite negative pressure in excess of the predetermined value is introduced into the fourth working chamber, to allow the other end of the sleeve member to open the perforation in the partition wall, thereby introducing the composite negative pressure into the first working chamber of the first diaphragm valve assembly.

6. A system as claimed in claim 1, wherein said means operable in response to the composite negative pressure comprises;

a first diaphragm valve assembly comprising a first valve casing including a first diaphragm member defining first and second working chambers one on each side of the first diaphragm member within said casing, said first diaphragm member being displaceable between first and second positions and normally biased to the first position, said second working chamber being communicated to the atmosphere, a linkage means for transmitting the displacement of the first diaphragm member to the shutter valve, said shutter valve being brought to the closed position against the biasing means when the first diaphragm member is displaced from the first position to the second position, a first suction passage means having one end communicated to the first working chamber of the first diaphragm valve assembly and the other end communicated to the first outlet duct at a position downstream of the shutter valve and including an electromagnetically operated switching valve operable in two different positions, said switching valve in one of said different positions establishing the communication between the first working chamber and the first outlet duct and said switching valve in the other of said different positions interrupting the communication between the first working chamber and the first outlet duct, a second diaphragm valve assembly comprising a second valve casing including a second diaphragm member defining third and fourth working chambers one on each side of the second diaphragm member within the second valve casing, said second diaphragm member being displaceable between engaged and disengaged positions, a second biasing means housed within the third working chamber for biasing the second diaphragm member to the disengaged position, a fluid suction passage means having one end communicated to the fourth working chamber and the other end constituted by first and second branch passages opening respectively into the first and second outlet conduits at positions downstream of the shutter valve and the throttle valve means, said second diaphragm member being diaplaced to the engaged position by the composite negative pressure when the latter exceeds the predetermined value, a actuator rod having one end rigidly connected to the second diaphragm member, and an electric circuit means having a switch operatively associated with said actuator rod such that, when said second diaphragm member is displaced from the disengaged position to the engaged position, said switch is closed, said electric circuit generating a control signal necessary to bring the electromagnetically operated switching valve to said one of the different positions when said switch is closed.

* * * * *